United States Patent [19]

Gentiluomo

[11] Patent Number: 5,000,066

[45] Date of Patent: Mar. 19, 1991

[54] RATCHET WRENCH

[76] Inventor: Paul A. Gentiluomo, 1456 Belmont Ave., Schenectady, N.Y. 12308

[21] Appl. No.: 180,685

[22] Filed: Apr. 8, 1988

Related U.S. Application Data

[63] Continuation of Ser. No. 510,773, Jul. 5, 1983, abandoned.

[51] Int. Cl.[5] ..... B25B 13/46

[52] U.S. Cl. ..... 81/62; 81/63

[58] Field of Search ..... 81/60–63.2; 192/43.1

[56] References Cited

U.S. PATENT DOCUMENTS

| | | | |
|---|---|---|---|
| 333,199 | 12/1885 | Gornog | 81/63 |
| 915,446 | 3/1909 | Kearnes | 81/63 |
| 3,532,013 | 10/1970 | Haznar | 81/62 |
| 3,967,514 | 7/1976 | Deutch | 81/63 |
| 4,274,311 | 6/1981 | Ebert | 81/63 |
| 4,277,989 | 7/1981 | Tracy | 81/62 |
| 4,300,413 | 11/1981 | Garofalo | 81/62 |
| 4,406,183 | 9/1983 | Wix | 81/62 X |

FOREIGN PATENT DOCUMENTS

| | | | |
|---|---|---|---|
| 112764 | 2/1918 | United Kingdom | 81/63 |

*Primary Examiner*—D. S. Meislin

[57] ABSTRACT

A ratchet wrench featuring a remote switch button located within the shank adjacent to the hand grip, for alternately changing the direction of ratcheting action upon successive actuation of the switch. The novelty resides in the uniqueness of the pawl shifting mechanism, and the pawl. The pawl has first and second toothed portions on one side, and transversely located on the other side is a second pawl camming surface having two inclined detent surfaces located beneath a first pawl camminig surface having specially contoured surfaces. The pawl shifting mechanism consisting of an actuator such as a leaf spring, a slide switch, button return spring, and a pawl detent, operate to engage the pawl's first and second camming surfaces, for positioning the pawl's toothed portions into contact with the ratchet gear at any one of two opposite positions. During slide switch button actuation, the leaf spring's free end flexes under cantilever action during engagement with the pawl's first camming surface to pivotally rotate it to a selectable position with either the first or second toothed portions into engagement with the ratchet gear. Also, the pawl detent operates to engage the second pawl camming surface, to maintain the selected ratcheting mode of operation. Upon release of the slide switch button, the return spring operates to return the switch button to its initial unactuated position. Therefore, successive actuation of the slide switch button will induce alternate clockwise and counterclockwise ratcheting action.

6 Claims, 2 Drawing Sheets

RATCHET WRENCH

This is a continuation of application Ser. No. 510,773 filed Jul. 5, 1983, now abandoned.

BACKGROUND OF THE INVENTION

This invention relates to the art of ratchet mechanisms, which have particular application to ratchet wrenches. While prior art ratchet wrenches appear suitable for their intended purpose, they exhibit various shortcomings. It has been observed that in order to change the direction of ratcheting action in most commercially available ratchet wrenches, two hands are required. One wrench design requires the user to hold the driven member stationary with one hand, while the selector knob is rotated with the other hand. If the driven member is not held stationary, the selector knob will rotate the driven member without changing the direction of ratcheting action. Also, when presently available wrenches are used in close working quarters or around moving machinery parts, it becomes either impossible or dangerous to grasp the selector knob to change the direction of ratcheting action. The herein disclosed invention obviates the above cited problems by utilizing a remote ratcheting direction control switch located just in front of the hand grip.

SUMMARY OF THE INVENTION

It is in regard to the solution to existing prior art shortcomings, that the instant invention is directed. The principal feature of this invention is to provide a ratchet wrench whereby reversing of ratcheting action is achieved by the use of thumb action, while the hand grasps the wrench hand grip portion. The wrench features a ratchet mechanism having an externally toothed driven member, and a uniquely contoured disc type pawl mounted within the head portion. Reversal of ratcheting action is achieved by a pawl shifting mechanism mounted within the shank portion of the wrench. The pawl shifting mechanism features a slide switch button with actuator slidably mounted within said shank portion, to effectuate rotation of the pawl to a selectable position in contact with the ratchet gear teeth, for providing either clockwise or counterclockwise ratcheting action. To facilitate socket removal from the socket holding stud, a pushbutton device associated with said socket holding stud can be utilized.

Based on the novel features of above cited wrench construction, it became apparent that further objects of this invention are as follows:

To provide a ratchet wrench that can be more readily used by handicapped persons having use of only one hand.

To provide a ratchet wrench wherein the direction of ratcheting action can be readily changed during use in space restricted working areas, without withdrawing the wrench to make the change.

To provide a ratchet wrench featuring a thin head portion, for use in tight work areas.

To provide a ratchet wrench offering maximum safety to the operator when used in dangerous locations around moving machinery parts, due to the location of the remote control means for reversing the direction of ratcheting action.

To provide a ratchet wrench having a minimum number of parts for accomplishing both ratchet reversing action, and socket release.

These objects and other objects of the invention should be discerned and appreciated from the description and claims, taken in conjuction with the accompanying drawings.

DESCRIPTION OF THE INVENTION

Figure 1:
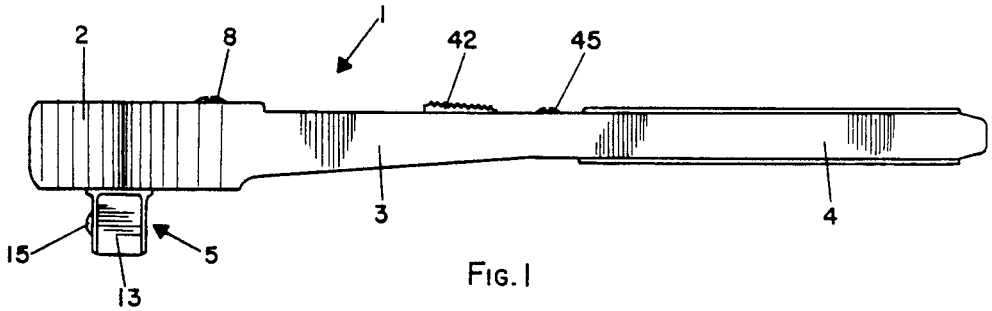
FIG. 1 is an elevation view of the first embodiment of the invention.

Referring to FIGS. 1 through 4 of the drawings, the first embodiment of the invention comprises a drive member 1 having a head 2, shank 3, and hand grip 4. Head 2 has provisions for accommodating rotatably journalled driven member 5, retaining bushing 6, and pawl 7 pivotably mounted about pivot screw 8. Pivot screw 8 is also used to secure retaining cap 9 within retaining cap cavity 10. Driven member 5 consists of ratchet gear 11 having gear boss 12 at its upper end, and stud 13 at its lower end. Located within one face of the lower square end of stud 13, is a socket detent assembly consisting of spring 14 and ball 15, retained within cavity 16 by staked edge 17. For accommodating driven member 5, head 2 has a progressively stepped bore consisting of bushing cavity 18 with retaining groove 19 for retaining bushing 6 through means of retaining ring 20, a ratchet gear cavity 21 for providing clearance around ratchet gear 11, gear boss cavity 22 for providing a bearing for ratchet gear boss 12, and are retaining bushing 6 with bearing bore 24 for providing bearing at the upper circular portion of stud 13. It is to be discerned that driven member 5 is axially constrained between shoulder and thrust bearing surface 25, and radially constrained between gear boss cavity 22 and bearing bore 24.

For accommodating pawl 7, head 2 has a pawl cavity 26 located adjacent to and intersecting ratchet gear cavity 21. Pawl 7 has a hole 28 protruding therethrough to receive pivot screw 8, which functions to maintain said pawl at a fixed distance from ratchet gear 11. Adjacent to the bottom end of pawl cavity 26, and within shank 3, is longitudinal pawl detent cavity 27 for containing compression spring 29. Pawl 7 is substantially in the form of a disc having a curved cut-out 30 intermediate oppositely disposed first toothed portion 31 and second toothed portion 32 on one side of said pawl, with first pawl camming surface 33 and second pawl camming surface 34 on the other side of said pawl. Second pawl camming surface 34 having inclined detent surfaces 35 and 36 disposed opposite and at the same level as pawl detent cavity 27. located intermediate second pawl camming surface 34 and pawl detent cavity 27, is ball 37, held in contact with either inclined detent surface 35 or 36 by action of compression spring 29. Above pawl detent cavity 27, and disposed longitudinally within the top portion of shank 3, is a wedge cut-out 39.

Interconnecting said wedge cut-out 38, along the top portion of shank 3, are longitudinal cut-outs 39 and 40. Cut-out guide 39 is functional in slidably containing an actuator such as leaf spring 41, and cut-out 40 is functional in containing slide button switch 42.

Retaining plate 43 is secured to shank 3 by means of screw 44 at one end, and retaining cap 9, which has a retaining slot 45 for capturing and holding down the other end. Leaf spring 41 is secured to slide switch 42 by means of spring pin 46. The rolled end 47 of leaf spring 41 is disposed over the pawl's second pawl camming surface 34, and in front of first pawl camming surface 33. First pawl camming surface 33 is defined by round nose 48, slide surfaces 49 and 50, stop cavities 51 and 52, and inclined stop surfaces 53 and 54. The bottom of slide switch button 42 has a rectangular cut-out 55 for retaining return spring 56. Also, for retaining return spring 56, is rectangular cut-out 57 located within shank 3 and opposite rectangular cut-out 55, when slide switch button 42 is in the retracted position shown in FIG.2.

Figure 3:
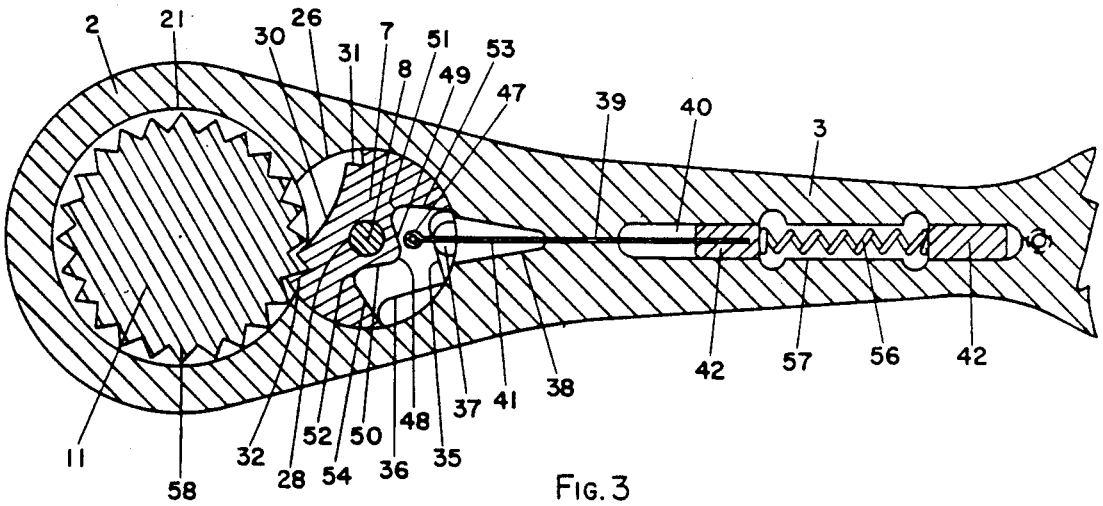
FIG. 3 is a cross-sectional view taken along cutting plane 3—3 of FIG. 2.

FIG. 3 depicts the wrench set at the clockwise mode of operation. To change to the counterclockwise made of operation, slide switch button 42 is actuated forward toward head 2. In so doing, leaf spring 41 will move forward until rolled end 47 contacts slide surface 49. Upon contact, the free end of spring 41 will deflect under cantilever action within the confines of wedge cut-out 38, as the rolled end 47 slides along slide surface 49 to stop cavity 51. Further movement of the slide switch button will force pawl 7 to pivotally rotate about pivot screw 8, as the rolled end becomes confined within stop cavity 51, and between slide surface 49 and inclined stop surface 53. Pawl 7 will pivot until the first toothed portion 31 engages ratchet gear teeth 58. Also, during pawl pivoting action, ball 37 will slide along inclined detent surface 35, onto inclined detent surface 36. With the pawl in this position, the effect of the pawl detent against inclined detent surface 36, will be to maintain the first toothed portion 31 in contact with ratchet gear teeth 58, as the wrench handle is oscillated to provide counterclockwise ratcheting action. After release of slide switch button 42, compressed return spring 56 will operate to retract said switch to its original starting position. Also, during retraction, the end of leaf spring 41 will straighten and assume the neutral undeflected on-center alignment shown in FIG. 3.

The next forward actuation of slide switch button 42 will reset the wrench to the clockwise mode of operation. In accomplishing this, leaf spring 41 will move forward until rolled end 47 contacts slide surface 50. Upon contact, the free end of spring 41 will deflect under cantilever action within the confines of wedge cut-out 38, as the rolled end 47 slides along slide surface 50 to stop cavity 52. Further movement of the slide switch button will force pawl 7 to pivotally rotate about pivot screw 8, as the rolled end becomes confined within stop cavity 52, and between slide surface 50 and inclined stop surface 54. Pawl 7 will pivot until the second toothed portion 32 engages ratchet gear teeth 58, Also, during pawl pivoting action, ball 37 will slide along inclined detent surface 36, onto inclined detent surface 35. With the pawl in this position, the effect of the pawl detent against inclined detent surface 35, will be to maintain the second toothed portion 32 in contact with ratchet gear teeth 58, as the wrench handle is oscillated to provide clockwise ratcheting action. After release of slide switch 42, compressed return spring 56 will again operate to retract said switch to its original starting position. Also, during retraction, the end of leaf spring 41 will again straighten and assume the neutral undeflected on-center alignment shown in FIG. 3.

It should be discerned that the pawl shifting mechanism is of such construction that every time the slide switch button 42 is actuated forwardly, driven member 5 will become interlocked with drive member 1, such that the wrench's direction of ratcheting action will be sucessively alternated.

Figure 5:
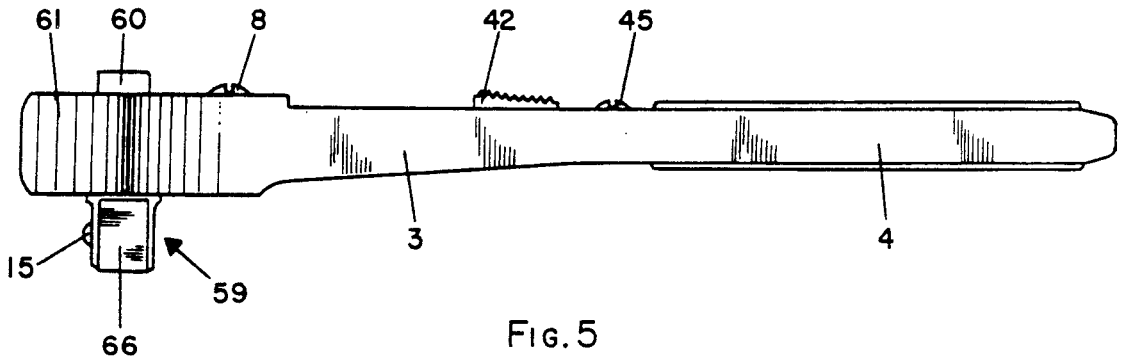
FIG. 5 is an elevation view of the second embodiment of the invention.
Figure 6:
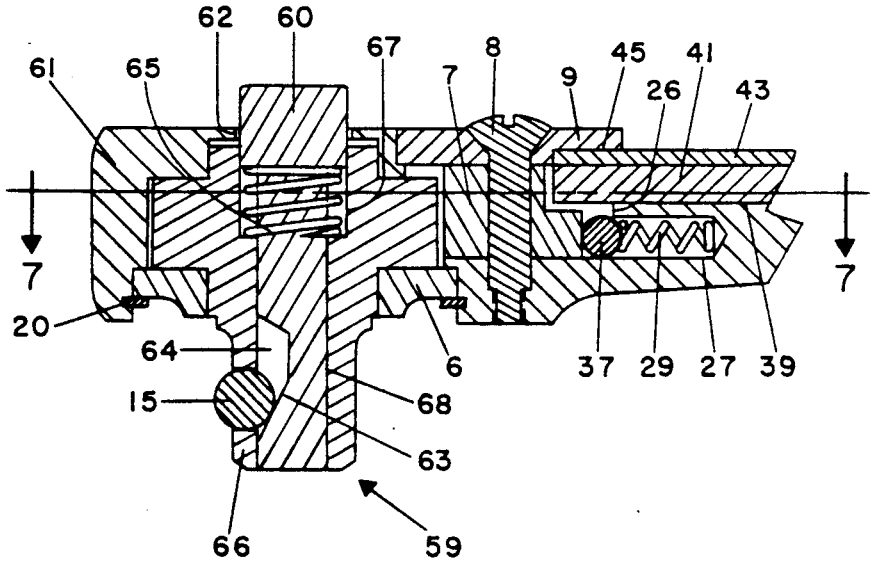
FIG. 6 is an enlarged cross-sectional elevation view of the head protion of the invention depicted in FIG. 5.
Figure 7:
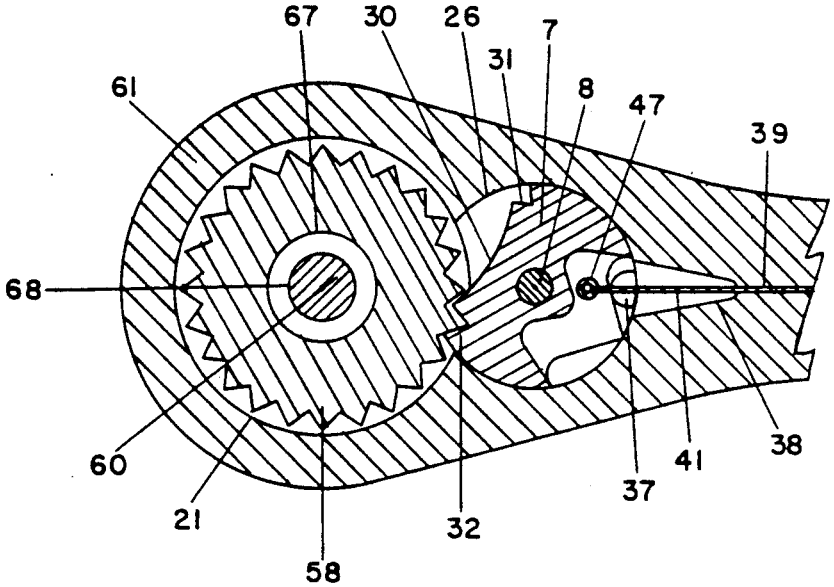
FIG. 7 is a cross-sectional view taken along cutting plane 7—7 of FIG. 6.

The second embodiment of the invention illustrated in FIGS. 5 through 7, differs from the embodiment illustrated in FIGS. 1 through 4, only in that driven member 5 is modified to accommodate a pushbutton actuator for automatically releasing sockets. Therefore, the various components or surfaces of this embodiment which are the same as those disclosed in the first embodiment, will be identified through use of the same reference numerals.

Figure 2:
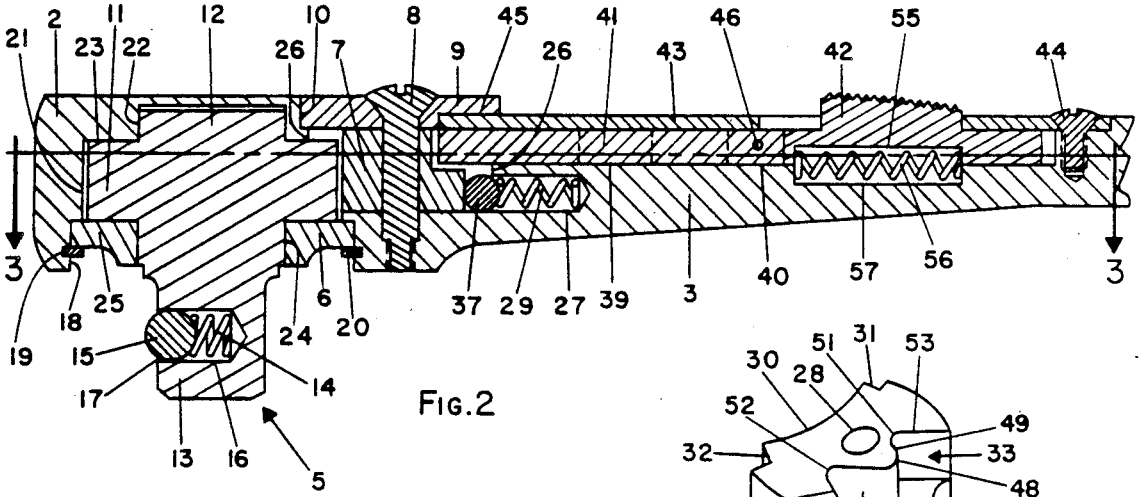
FIG. 2 is an enlarged cross-sectional elevation view of the invention depicted in FIG. 1, less the hand grip portion.
Figure 4:
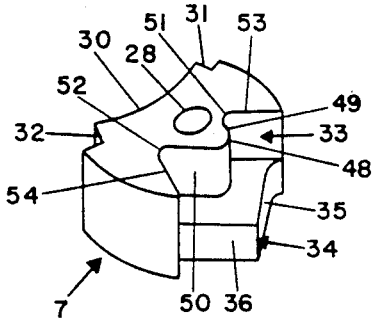
FIG. 4 is an enlarged isometric view of the pawl.

With reference to FIG. 6, it can be discerned that driven member 59 differs from driven member 5 of FIG. 2, by inclusion of pushbutton actuator 60 to control the detent action of ball 15. To accommodate pushbutton 60, driven member 59 has a dual bore consisting of upper bore 67 and lower bore 68. Also, head 61 of the second embodiment differs from head 2 of the first embodiment, by the inclusion of bore 62 to provide operating clearance for pushbutton actuator 60. Pushbutton actuator 60 includes a longitudinal cut-out having inclined surface 63 merging with recess 64. Spring 65 is used to return actuator 60 to its outermost position and to maintain inclined surface 63 in contact with ball 15. This action will always push ball 15 outward, to provide the pressure required for retaining conventional sockets to stud 66.

Since the construction and operation of the wrench mechanisms for performing ratcheting action in the disclosed embodiments are identical, and since quick release mechanisms for sockets are well documented in the art as evidenced from U. S. Pat. Nos. 3,202,318, 3,532,013, 4,211,127, and 4,347,767, more detailed disclosure of the second embodiment is not necessary and therefore will not be presented.

Key terms used herein should bear the following interpretations:

Pawl Shifting Mechanism—It includes elements contained within the wrench's shank for pivotally rotating and maintaining the pawl in a selected operative position.

Socket Retention Device—It is a device operatively mounted within the wrench's driven member, for the purpose of retaining sockets onto the stud.

Pawl Camming Surfaces—Construed to include pawl surfaces of such contour as to effect proper operation of the pawl shifting mechanism.

Having thusly described the invention, the following is claimed:

1. A ratcheting device comprising:

(a) a drive member including a head, shank, and hand grip;

(b) a driven member including a ratchet gear rotatably mounted within the head of said drive member;

(c) a pawl mounted to pivotally rotate within said head at a position adjacent to and at a fixed distance from said ratchet gear, and further characterized as having oppositely disposed first and second toothed portions on one side, and first and second pawl camming surfaces transversely located at the other side;

(d) and a pawl shifting mechanism mounted within the shank of said drive member, including a pawl detent in operative engagement with said second pawl camming surface, and a slidably mounted switch button directly connected to a leaf spring whose free end bends within said head during operative engagement with said first pawl camming surface;

(e) said leaf spring having a section intermediate its free end and said switch button, which is guided within said shank so that said free end always deflects back to its neutral on-center alignment after switch button retraction;

(f) also, said pawl being positioned to a selectable position with engagement of either said first or said second toothed portions with said ratchet gear, for effectuating alternate clockwise or counterclockwise ratcheting action upon actuation of said switch button.

2. The invention as defined by claim 1, wherein said switch button is held in the retracted position by means of a spring commonly mounted within said shank and within the bottom of said switch button.

3. The invention as defined by claim 2, wherein said driven member is further characterized as including a stud projecting from the bottom of said ratchet gear.

4. The invention as defined by claim 3. wherein said driven member is further characterized as including a socket retention device.

5. The invention as defined by claim 4 , wherein said socket retention device is further characterized as consisting of a ball which is spring loaded and slidably mounted within one face of said stud.

6. The invention as defined by claim 4, wherein said socket retention device is further characterized as being of the quick release type including a ball slidably mounted within one face of said stud, an axially mounted pushbutton actuator having a cut-out at its lower end defined by an inclined surface located adjacent to said ball, and a spring contained within said driven member to move said pushbutton actuator such that its inclined surface operates to urge said ball to its outermost protruding position.

* * * * *